US011156967B2

(12) United States Patent
Rieder et al.

(10) Patent No.: US 11,156,967 B2
(45) Date of Patent: Oct. 26, 2021

(54) ELECTROMECHANICAL TIMEPIECE MODULE COMPRISING AN ANTENNA

(71) Applicant: Soprod SA, Sion (CH)

(72) Inventors: Médard Rieder, Wiler (CH); Romain Clivaz, Gröne (CH)

(73) Assignee: Soprod SA, Sion (CH)

( * ) Notice: Subject to any disclaimer, the term of this patent is extended or adjusted under 35 U.S.C. 154(b) by 0 days.

(21) Appl. No.: 16/637,673

(22) PCT Filed: Aug. 3, 2018

(86) PCT No.: PCT/IB2018/055853
§ 371 (c)(1),
(2) Date: Feb. 7, 2020

(87) PCT Pub. No.: WO2019/034958
PCT Pub. Date: Feb. 21, 2019

(65) Prior Publication Data

US 2020/0201265 A1 Jun. 25, 2020

(30) Foreign Application Priority Data

Aug. 17, 2017 (CH) ..... CH01033/17

(51) Int. Cl.
*G04R 60/02* (2013.01)
*G04R 60/14* (2013.01)

(52) U.S. Cl.
CPC ..... *G04R 60/02* (2013.01); *G04R 60/14* (2013.01)

(58) Field of Classification Search
CPC ..... G04R 60/02; G04R 60/14; G04R 60/06; G04R 60/12; G04G 21/04
(Continued)

(56) References Cited

U.S. PATENT DOCUMENTS 7,158,449 B2 * 1/2007 Fujimori ..... G04C 3/008 368/160
7,187,908 B2 * 3/2007 Fujisawa ..... G04B 47/00 340/5.1

(Continued)

FOREIGN PATENT DOCUMENTS

CN 1514958 A 7/2004
CN 102495543 A 6/2012

(Continued)

OTHER PUBLICATIONS

International Search Report for PCT/IB2018/055853, dated Dec. 13, 2018, 2 pages.

(Continued)

*Primary Examiner* — Edwin A. Leon
(74) *Attorney, Agent, or Firm* — Blank Rome LLP

(57) ABSTRACT

An electromechanical timepiece module (1) has a main plate (10) with an actuator module (40) driving at least one mobile part (30) by a gear train (42). The mobile part (30) displays a time or non-time function. A wireless communication module (2) is configured for transmitting and/or receiving a wireless signal. And a control unit (6) is configured for controlling the actuator module (40) depending on a received wireless signal. The mobile part (30) and the gearing (42) are made of an electrically conductive material and are in electrical contact with each other but electrically isolated from the remainder of the timepiece module (1). The mobile part (30) is electrically connected to the communication module (2) so as to act as an antenna for the transmission and/or reception of the wireless signal and to transmit the wireless signal between the mobile part (30) and the wireless communication module (2).

13 Claims, 2 Drawing Sheets

(58) Field of Classification Search
USPC ..... 368/47, 10
See application file for complete search history.

(56) References Cited

U.S. PATENT DOCUMENTS

| | | | | |
|---|---|---|---|---|
| 9,141,089 | B1 | 9/2015 | Liou et al. | |
| 9,575,469 | B2 | 2/2017 | Liou et al. | |
| 10,180,660 | B2 * | 1/2019 | Hosobuchi ..... | G04C 3/146 |
| 2006/0164921 | A1 | 7/2006 | Gunnarsson et al. | |
| 2015/0185707 | A1 | 7/2015 | Liou et al. | |
| 2016/0103428 | A1 | 4/2016 | Fujisawa | |

FOREIGN PATENT DOCUMENTS

| | | | |
|---|---|---|---|
| CN | 104749948 | A | 7/2015 |
| CN | 106207459 | A | 12/2016 |
| CN | 106229690 | A | 12/2016 |
| DE | 3508366 | A1 | 12/1985 |
| DE | 8815967 | | 9/1989 |
| DE | 4441424 | A1 | 8/1995 |
| EP | 0348636 | | 9/1989 |
| EP | 3115853 | A1 | 1/2017 |

OTHER PUBLICATIONS

Chinese Office Action and Translation for CN 201880052960.9, dated Dec. 3, 2020, 14 pgs.

* cited by examiner

ELECTROMECHANICAL TIMEPIECE MODULE COMPRISING AN ANTENNA

RELATED APPLICATIONS

The present application is a national phase of International patent application PCT/IB2018/055853 filed Aug. 3, 2018, which claims priority to Swiss Application No. CH01033/17 filed Aug. 17, 2017. The entire contents of those applications are hereby incorporated by reference.

TECHNICAL FIELD

The present invention relates to an electromechanical timepiece module comprising an antenna for transmitting and/or receiving a wireless signal.

PRIOR ART

Watches having a wireless communication function are known. To this end, an antenna must be placed in the confined space of the watch. As the reception of the antenna is disrupted in the vicinity of an electrically conductive material, the antenna has often been placed outside the casing. For example, in documents DE3508366 and DE8815967, an antenna is incorporated into the strap. Such an arrangement has the disadvantage that the antenna is vulnerable to breakage. Otherwise, the antenna is most often placed around a dial of the watch, the metal casing of the watch serving as ground plane. The antenna may also be placed on a bezel of the watch.

However, placing an antenna on the exterior has the disadvantage of being incompatible with the esthetic criteria of a watch. In particular, the external parts of a watch preferably comprise metal parts, such as the casing and the dial, with a high-precision finish. An antenna placed on the exterior of the casing then compromises the attractiveness of the watch and must therefore be covered in order not to degrade the appearance of the exterior.

In more recent developments, the antenna has been housed inside the casing, under the dial. In such an arrangement, the mechanical and electrical connections between the movement of the watch and the antenna are less open to exterior interference.

In document DE4441424, an antenna is housed in a non-metallic casing comprising a dial that is also non-metallic. However, casings and dials manufactured from non-metals do not always meet the esthetic criteria normally accepted in the watch and clock making industry. In addition, such casings and dials do not allow the expected mechanical properties to be obtained.

Furthermore, in the case where the external parts are made of metal, the latter will play the role of electromagnetic shielding with respect to the antenna and the performance of the antenna will be unsatisfactory. The challenge is therefore to ensure a consistent antenna reception and emission quality while using the materials that have conventionally been used to manufacture the external parts of the watch and the dial.

In document US2006164921, an annular antenna is housed inside the casing, which comprises a metal dial. The antenna is placed at a distance larger than 0.5 mm from the dial. This distance is sufficient to allow an adequate reception.

BRIEF SUMMARY OF THE INVENTION

One aim of the present invention is to provide an antenna-comprising electromechanical timepiece module exempt from the limitations of known timepiece modules.

According to the invention, these aims are achieved especially by means of an electromechanical timepiece module comprising a main plate comprising an actuating module that drives at least one moving part via a gear train, the moving part being intended to display a function related or unrelated to time; a wireless communication module configured to transmit and/or receive a wireless signal; and a control unit configured to control the actuating module depending on a received wireless signal; the moving part and the gear train being manufactured from an electrically conductive material and making electrical contact with each other but being electrically insulated from the rest of the timepiece module; the moving part being electrically connected to the communication module so as to act as an antenna for the transmission/or reception of the wireless signal and to transmit the wireless signal between the moving part and the wireless communication module.

The antenna-comprising electromechanical timepiece module of the invention allows a good antenna emission and reception performance to be obtained in the case where the module comprises an electrically conductive dial and is placed in an electrically conductive casing.

BRIEF DESCRIPTION OF THE FIGURES

Examples of implementation of the invention are indicated in the description, which is illustrated by the appended figures, in which.

EXAMPLE(S) OF EMBODIMENT

Figure 1:
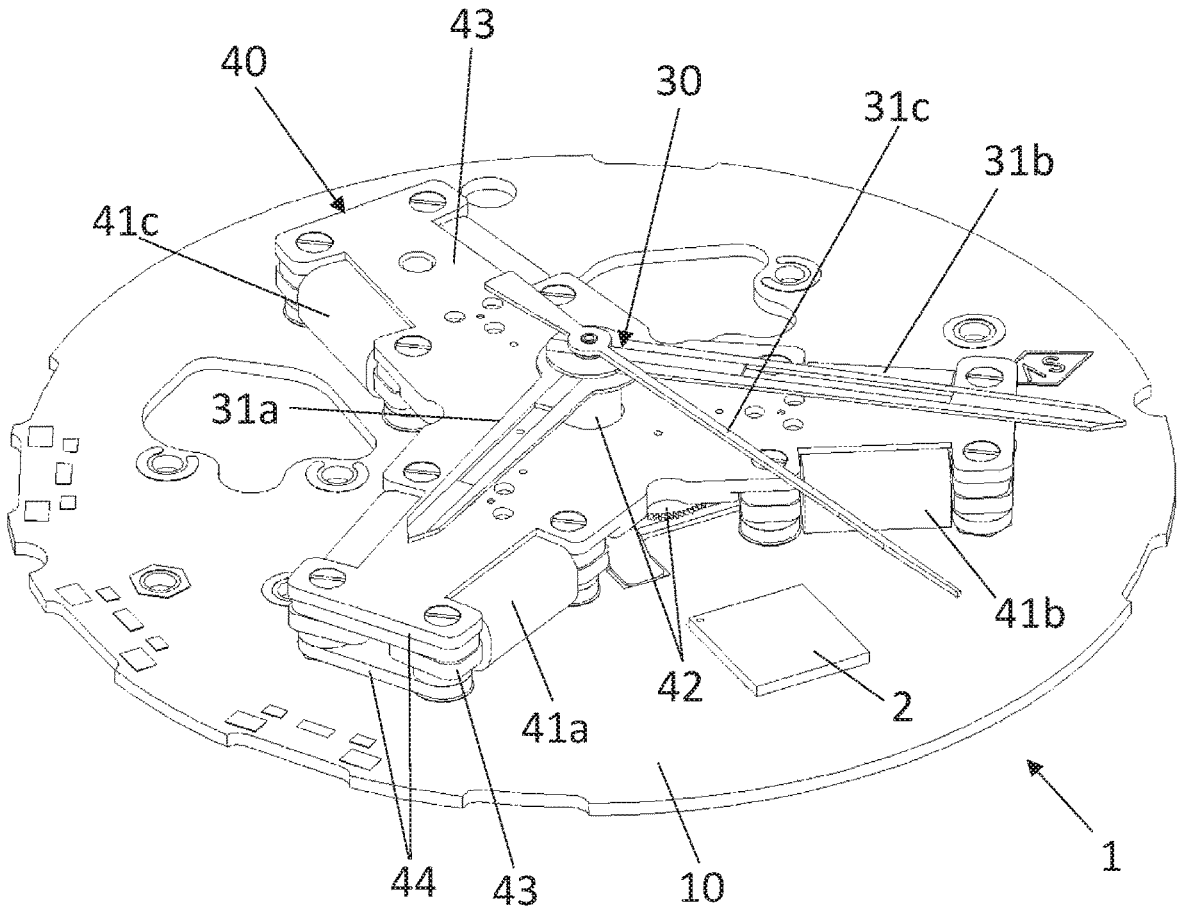
FIG. 1 illustrates an electromechanical timepiece module, according to one embodiment.

An electromechanical timepiece module 1 is shown in FIG. 1. The module 1 comprises a main plate 10 comprising an actuating module 40 that drives at least one moving part 30 via a gear train 42. The moving part 30 is intended to display a function related or unrelated to time. The module 1 comprises a wireless communication module 2 configured to transmit and/or receive a wireless signal and a control unit 6 configured to control the actuating module 40 depending on a received wireless signal. The moving part 30 and the gear train 42 are manufactured from an electrically conductive material and make electrical contact with each other but are electrically insulated from the rest of the timepiece module 1.

The moving part 30 is electrically connected to the communication module 2 so as to act as an antenna for the transmission and/or reception of the wireless signal and to transmit the wireless signal between the moving part 30 and the wireless communication module 2.

In one embodiment, the actuating module 40 comprises a motor 41 and the gear train 42, which transfers the movement of the motor 41 to the moving part 30, the actuating module 40 not being electrically connected to the main plate 10.

Preferably, the main plate 10 comprises a printed circuit board on which the actuating module 40 is mounted. Other electrical or electronic components of the timepiece module 1, such as the communication module 2, may also be mounted on the printed circuit board.

According to one form of execution, the actuating module 40 comprises a gear-train plate 44 that supports the gear train 42. The gear-train plate 44 is preferably manufactured from an electrically nonconductive material.

In the example of FIG. 1, the actuating module 40 comprises three motors 41*a*, 41*b* and 41*c*, each motor allowing an hour hand 31*a*, a minute hand 31*b* and a second hand 31*c* to be made to move, respectively. In particular, the actuating module 40 comprises a stator 43 comprising three branches, each bearing one coil 41*a*, 41*b*, 41*c*. The hands 31*a*, 31*b*, 31*c* are mounted so as to be able to pivot in the plane of the main plate 10. The three branches may make an angle of about 120° to one another. The stator may also have a two-branch shape, each branch bearing one coil so as to drive two concentrically arranged hands.

The timepiece module 1 may comprise a capacitive circuit configured to match impedance depending on the angular position of the one or more hands 31*a*, 31*b*, 31*c*.

The actuating module 40 may have other configurations and may be configured to make move only a single hand or two hands, or even a plurality of disks or any other type of moving part. For example, the actuating module 40 may comprise a bidirectional motor that actuates a retrograde hand.

Figure 2:
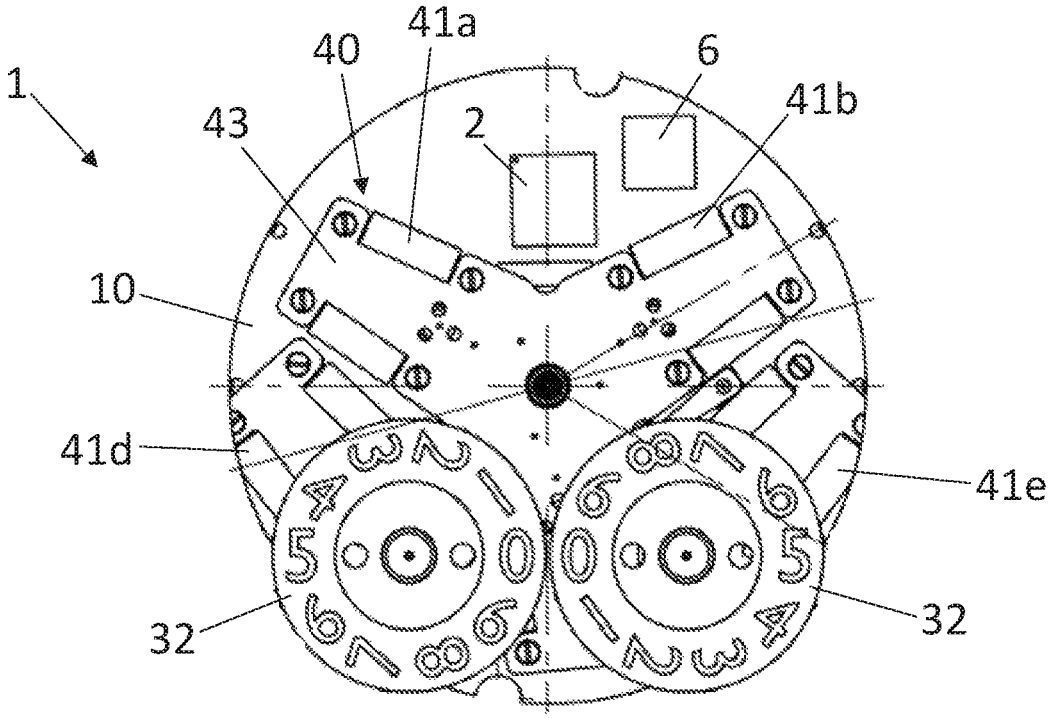
FIG. 2 shows the timepiece module according to another embodiment.

The example of FIG. 2 shows the module in another configuration, comprising an actuating module 40 comprising three motors 41*a*, 41*b* and 41*c* such as shown in FIG. 1 and able to make an hour hand, a minute hand and a second hand move (which are not illustrated in FIG. 2). The module 1 also comprises two motors 41*d*, 41*e* the stator of which comprises one branch, each driving one disk 32, date disks for example. The disks 32 are arranged so as to pivot in the plane of the main plate 10. Each of the motors 41*d*, 41*e* may also drive a hand, for example a retrograde hand in the case of bidirectional motors.

According to one form of execution, a spring element (not shown) may be configured to transmit the wireless signal between the moving part 30 and the wireless communication module 2.

Again according to one form of execution, the moving part 30 and the gear train 42 are configured to achieve an antenna resistance of about 50 ohms. The antenna resistance of about 50 ohms may be obtained via the choice of the materials from which the moving part 30 and the gear train 42 are made.

The module 1 may comprise a dial (not illustrated). The dial is preferably electrically insulated from the moving part 30 and from the gear train 42.

One advantage of the module 1 of the invention is that the dial may be manufactured from any material.

The module of the invention may be integrated into a watch comprising a casing containing the module 1 according to the invention, the casing being electrically insulated from the moving part 30 and from the gear train 42.

REFERENCE NUMBERS EMPLOYED IN THE FIGURES

1 electromechanical timepiece module
10 main plate
2 wireless communication module
30 moving part
31*a* hour hand
31*b* minute hand
31*c* second hand
32 disk
40 actuating module
41 motor
41*a*, 41*b* and 41*c* coil
41*d*, 41*e* coil
42 gear train
43 stator
44 gear-train plate
6 control unit

The invention claimed is:

1. An electromechanical timepiece module comprising a main plate comprising an actuating module having a motor that drives at least one moving part via a gear train, the moving part being intended to display a function related or unrelated to time and moving in a plane of the main plate;

a wireless communication module configured to transmit and/or receive a wireless signal; and a control unit configured to control the actuating module depending on a received wireless signal;

the moving part and the gear train being manufactured from an electrically conductive material and making electrical contact with each other but being electrically insulated from the rest of the timepiece module;

the moving part being electrically connected to the communication module so as to act as an antenna for the transmission and/or reception of the wireless signal and to transmit the wireless signal between the moving part and the wireless communication module.

2. The module according to claim 1, wherein the actuating module comprises the motor and the gear train, which transfers the movement of the motor to the moving part, the actuating module not being electrically connected to the main plate.

3. The module according to claim 1, wherein the actuating module comprises a gear-train plate that supports the gear train, the gear-train plate being manufactured from an electrically nonconductive material.

4. The module according to claim 1, comprising a spring element configured to transmit the wireless signal between the moving part and the wireless communication module.

5. The module according to claim 1, wherein the moving part and the gear train are configured to have an antenna resistance of about 50 ohms.

6. The module according to claim 5, wherein the antenna resistance of about 50 ohms is obtained via the choice of the materials from which the moving part, the gear-train plate and the gear train are made.

7. The module according to claim 1, wherein the moving part comprises a disk that is mounted so as to be able to pivot in the plane of the main plate.

8. The module according to claim 1, wherein the moving part comprises at least one hand that is mounted so as to be able to pivot in the plane of the main plate.

9. The module according to claim 8, comprising a capacitive circuit configured to match impedance depending on an angular position of the hand.

10. The module according to claim 1, wherein the motor comprises a bidirectional stepper motor.

11. The module according to claim 1, wherein the main plate comprises a printed circuit board.

12. The module according to claim 1, comprising a dial electrically insulated from the moving part and from the gear train.

13. Watch comprising a casing containing the module according to claim 1, the casing being electrically insulated from the moving part and from the gear train.

* * * * *